United States Patent [19]

Klein

[11] Patent Number: 5,072,941

[45] Date of Patent: Dec. 17, 1991

[54] GOLF PUTTER

[76] Inventor: Robert Klein, 1177 Bazett Rd., Kelowna, British Columbia, Canada, V1Z 2T4

[21] Appl. No.: 485,501

[22] Filed: Feb. 27, 1990

[51] Int. Cl.[5] ..... A63B 53/04

[52] U.S. Cl. ..... 273/164; 273/167 H; 273/167 A; 273/174; 273/80 A

[58] Field of Search ..... 273/167–175, 273/164, 183 D, 80 A; D21/217–219

[56] References Cited

U.S. PATENT DOCUMENTS

| | | | |
|---|---|---|---|
| D. 182,485 | 4/1958 | Sprinkel | 273/164 X |
| D. 185,522 | 6/1959 | Whitney | 273/164 X |
| D. 192,473 | 3/1962 | Ray | 273/167 D X |
| D. 196,736 | 10/1963 | De Carlo | 273/167 D X |
| D. 197,238 | 12/1963 | Lilly | 273/167 D X |
| D. 228,003 | 7/1973 | Warner | 273/164 X |
| D. 229,204 | 11/1973 | Romero | 273/167 J |
| D. 231,624 | 5/1974 | Wilmoth | 273/167 D |
| D. 248,181 | 6/1978 | Cervantes | 273/167 A X |
| 837,030 | 11/1906 | Blanchard | 273/169 X |
| 1,537,320 | 5/1925 | Marsh | 273/167 G |
| 2,503,506 | 4/1950 | Miller | 273/77 |
| 2,954,231 | 9/1960 | Macintyre | 273/169 X |
| 3,319,962 | 5/1967 | Summers | 273/167 G X |
| 3,680,860 | 8/1972 | Elkins | 273/167 R X |
| 3,758,115 | 9/1973 | Hoglund | 273/164 |
| 3,810,631 | 5/1974 | Braly | 273/167 A |
| 3,880,430 | 4/1975 | McCabe | 273/183 |
| 3,888,484 | 6/1975 | Zitko | 273/80 |
| 3,888,492 | 6/1975 | Cabot | 273/173 X |
| 3,917,277 | 11/1975 | Beck | 273/163 R |
| 3,955,819 | 5/1976 | Yokich | 273/164 |
| 4,138,117 | 2/1979 | Dalton | 273/164 |
| 4,141,556 | 2/1979 | Paulin | 273/164 |
| 4,330,128 | 5/1982 | Morelli | 273/173 |
| 4,361,329 | 11/1982 | Brock | 273/171 X |
| 4,367,877 | 1/1983 | Gibson et al. | 273/164 |
| 4,629,193 | 12/1986 | Pierman | 273/164 |
| 4,688,798 | 8/1987 | Pelz | 273/164 |
| 4,754,976 | 7/1988 | Pelz | 273/169 |
| 4,834,387 | 5/1989 | Waites et al. | 273/164 |
| 4,850,593 | 7/1989 | Nelson | 273/167 E |
| 4,964,639 | 10/1990 | Tucker | 273/164 |

FOREIGN PATENT DOCUMENTS

| | | | |
|---|---|---|---|
| 52-6236 | 1/1977 | Japan | 273/167 R |
| 25564 | 8/1906 | United Kingdom | 273/167 J |
| 340579 | 1/1931 | United Kingdom | 273/167 E |
| 727051 | 3/1955 | United Kingdom | 273/167 R |

OTHER PUBLICATIONS

"Golf Digest" magazine, (Jul. 1972 issue), p. 83.
"Golf Digest" magazine, (Dec. 1973 issue), pp. 45–47.
"Golf Digest" magazine, (Dec. 1977 issue), pp. 122–123.

*Primary Examiner*—Edward M. Coven
*Assistant Examiner*—Sebastiano Passaniti
*Attorney, Agent, or Firm*—Venable, Baetjer, Howard & Civiletti

[57] ABSTRACT

An improved golf putter having a T-shaped putter head is provided with an elongated sighting surface for assisting a player in aligning a putt. The sighting surface has a relatively light color and a relatively dark line or groove down the center. A portion of the bottom of the putter head is concaved to provide a cushioning effect as the putter head glides over the ground and air is trapped in the concaved region. The stem of the golf putter is mounted to the side of the putter head substantially rearward of the striking face.

19 Claims, 2 Drawing Sheets

GOLF PUTTER

BACKGROUND OF THE INVENTION

The present invention relates to an improved golf putter designed to enhance the accuracy of a player's putt.

A conventional golf putter normally includes a putter head having a striking face and a shaft projecting upwardly from the putter head at an angle to the vertical. During a putting stroke, the player typically stands with his or her side essentially pointing in the direction of intended travel for the golf ball and grips the free end of the shaft. Aligning the putter head in the proper direction, however, is often difficult when done from such a side position. For instance, the player must alternate between looking down at the putter head near his or her feet and turning his or her head at an angle to survey the intended line. As the player executes a putting stroke, the putter shaft is swung through a plane at an incline to the vertical. The tendency with such a stroke, however, is to curve the golf putter head away from a straight and forward path.

Various putters have been designed, therefore, to resist the tendencies to twist the golf putter during a stroke and to assist the player in aligning the putter head.

SUMMARY OF THE INVENTION

The present invention relates to an improved golf putter that aids the player in aligning a putt and in following through with a smooth, controlled stroke. Accordingly, a golf putter is provided with a shaft, a putter head, and a stem interconnecting the shaft and the putter head.

The putter head comprises an elongated striking body having a ball striking face on a forward end thereof. An elongated alignment platform extends rearwardly from the striking body such that the striking body and the alignment platform substantially form a T-shape. The putter head is provided with an elevated sighting surface of a relatively light color for assisting the player in aligning the putt. A dark line or groove is provided on the sighting surface for the alignment of shorter distanced putts.

The stem is mounted to the putter head at the side of the alignment platform. The bottom surface of the alignment platform is concaved in a region rearward of the striking body. The concaved region provides a cushion effect as the putter head glides over the ground. The bottom surface also slopes upwardly towards the rear end of the alignment platform to allow clearance during the follow through of a stroke.

DETAILED DESCRIPTION OF THE PREFERRED EMBODIMENTS

The present invention relates to an improved golf putter designed to enhance the accuracy of a player's putt. Accordingly, the golf putter is configured such that the player can more easily align the putter head with the intended line of shot. In addition, the improved design allows the player to more smoothly and evenly execute a putting stroke.

Figure 1:
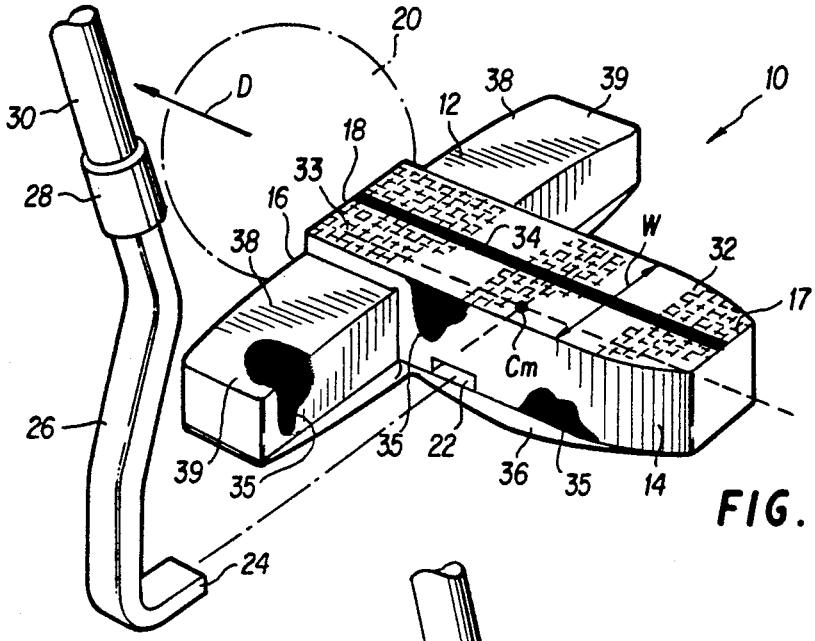
FIG. 1 illustrates a partially exploded, fragmented, perspective view of the putter head, stem, and shaft of a first embodiment of the present invention.

FIG. 1 represents a preferred embodiment of the present invention. Generally, the putter head 10 of the present invention has a substantially "T" shaped configuration formed from a lateral striking body 12 and an alignment platform 14. The alignment platform 14 intersects the striking body 12 essentially at a right angle. At a forward end of the striking body 12 is a ball striking face 16. The alignment platform 14 extends rearwardly from the striking body 12, directly behind the sweet spot 18 of the ball striking face. The sweet spot 18 is that portion of the ball striking face 16 which transmits the most kinetic energy to a golf ball 20 upon impact. Commonly, the sweet spot 18 is the area of the ball striking face directly in front of the center of mass cm of the putter head 10. A rectangular slot 22 is located in the heel side of the alignment platform 14 for receiving an end 24 of a stem 26. The other end 28 of stem 26 is connected to a shaft 30 (shown in fragment) that is provided with a grip (not shown) at its free end.

The following is a more detailed description of the features of the present invention which aid the player during each stage of the putting process. The player's putting process can be broadly divided into three stages. The first is the alignment stage where the player aligns the putter head 10 with the intended direction of travel (illustrated by arrow D) of the golf ball 20. The second stage involves the movement of the player from an alignment stance to a position of readiness for executing the putting stroke. Finally, the third stage involves the actual swing of the golf putter during the execution of the putting stroke.

Concerning the alignment stage, the alignment platform 14 is provided with a sighting surface 32 which, preferably, has a yellow shade of color, as represented by shading 33 (only part of the yellow shading is illustrated in FIG. 1 for clarity) and black stripe and/or groove 34 extending down the center of the sighting surface 32 from the forward face 16 to the rear 17 of the putter head 10. The remainder of the putter head 10 is preferably black, as represented by shading 35 (only portions of the black shading are illustrated in FIG. 1 for clarity), with the possible exception of the bottom surface 36 as explained in more detail further below. The elongated shape of the platform 14 in coordination with the contrasting colors of the sighting surface 32, the line 34 and the remainder of the putter head 10 serve to assist the player in aligning the putter head 10 in the correct direction D.

In practice the player stands behind the putter head 10 grasping the shaft 30 with one hand to the side while surveying the intended line. In this position, the player lines up the sighting surface 32 with the desired direction D of travel for the golf ball 20. This stance allows the player to keep his eyes looking forward and his line of sight parallel to the ground, a more natural position when aiming the putter head 10 as opposed to aligning a putt from a side position where the player's head would be at an angle. The width W of the alignment platform 14 is slightly less than the golf ball 20 to assist the player in directing the sweet spot 18 into the golf ball 20 during a putting stroke.

The yellow color of the sighting surface 32 visually dominates the putter head 10 so that the player can easily judge the position of the putter head with respect to the intended line and direction D. Furthermore, the yellow color remains extremely visible even in overcast or darkened conditions. The wideness of the yellow surface 32 is particularly useful for the player in making putts of approximately 20 feet or more. With the longer putts, the player aims more for an area than for a one inch target. The wideness of the yellow sighting surface 32 gives the player a better sense of direction for the longer putts.

The thin black line 34 is useful for the shorter putts where precise aiming is required. The black line 34 allows the player on short distances to aim to the left, the right or the center of the cup depending on the player's perception of the unevenness of the surface over which the golf ball 20 will travel toward the cup. Although the golf putter has been described in terms of having yellow and black colors, any sufficiently contrasting colors may be substituted.

As a secondary role in visually enhancing the player's ability to align the putter head 10, the lateral sides 38 of the striking body 12 are at a lower elevation than the sighting surface 32. In addition, the upper surfaces of the outer regions 39 of the lateral sides 38 slope further downwardly as better shown in FIG. 2. The descending elevation of the lateral sides 32 help guide the player's eyes to the sighting surface of 32 creating a 3-dimensional effect.

For the second stage of the putting process, the player moves from behind the putter head 10 to the side of the golf putter to take his or her position in preparation for striking the golf ball 20. Certain features of the golf putter allow the player to take his or her striking position without disturbing the alignment of the putter head 10.

Due to the "T" shaped configuration of the putter head 10, the putter head 10 rests firmly on the ground much like a tripod; i.e., the forward striking body 12 is stabilized in position by the added support provided by the bottom 45 of the alignment platform 14. The bottom surface 43 of the striking body and the lowermost surface 45 of the bottom of the alignment platform 14 lie in a plane substantially parallel to the sighting surface 32. In this way, when the player moves from an alignment stance to a stroking stance the putter head 10 stays firmly in position.

Figure 2:
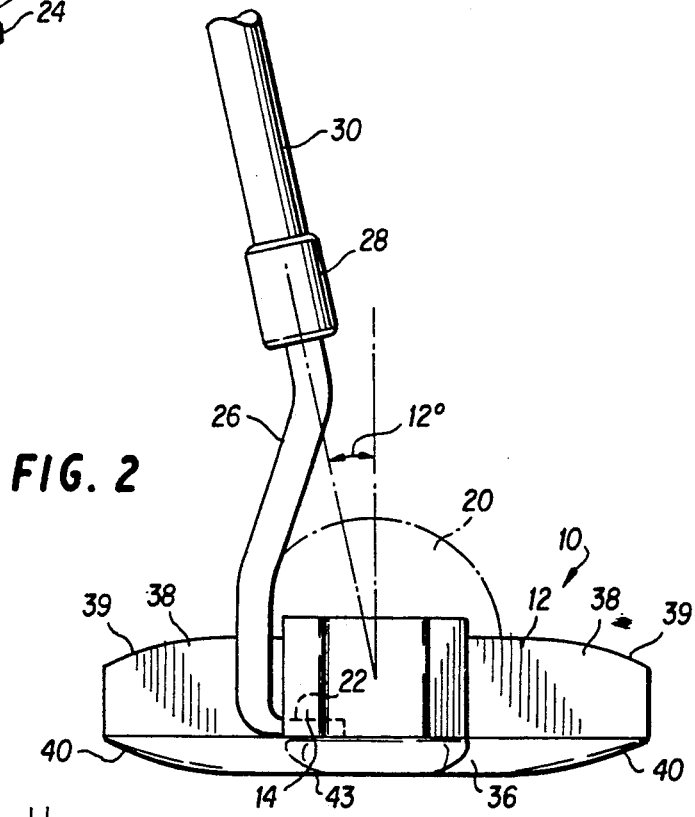
FIG. 2 illustrates a rear view of the first embodiment of the present invention.

As the player moves to firmly grip the golf club during the stroking stance, he may tilt the putter head 10 slightly towards himself. The upwardly sloping outer edges 40 of the bottom of the striking body 12 (as illustrated in FIG. 2) allow the player to tilt the putter head 10 slightly without pivoting the putter head 10 out of alignment.

In the third stage, when the player proceeds to stroke the golf ball 20 in its intended direction D, certain features of the golf putter enhance the player's ability to make a smooth, even, yet controlled stroke. The golf putter is weight balanced so the player can execute a low-sweeping, controlled putting stroke. Preferably, the putter head 10 is made from aluminum and has approximately a one-fourth inch layer of brass on the bottom 36. The layer 36 does not have to be black since it is not adjacent the sighting surface 32. The brass layer is attached to the aluminum piece by known appropriate methods. The putter head 10 is, therefore, heavier than the average putter. Preferably, the putter head 10 is approximately thirty percent heavier than the average putter. With a heavier putter head 10, the player makes a less forceful stroke in order to propel the golf ball 20 forward. This gives the player more control over the putt than if a more powerful stroke was needed. With a powerful stroke the player must exert more energy and body movement (typically by use of a longer swing arc) which creates a greater chance for error.

The positioning and shape of the stem 26 also help to improve the control and quality of the player's putting stroke. As illustrated in FIGS. 1 and 2, the end 24 of the stem 26 and the receiving slot 22 are rectangular in shape. This gives the player a strong sense of control over the putter head 10. In addition, the side mounting of stem 26 in the alignment platform 14, allows the player to make a low-sweeping, pendulum-like stroke. When the stem is attached to or near the upper surface of the putter head, there is a tendency to drag the putter head through the hitting area causing the striking face 16 to open slightly. A similar dragging or pulling tendency is found when the stem is mounted near the striking face 16 of the putter head. With the present mounting configuration, i.e. a relatively rearward, side mount of the stem 26, the player has a tendency to push the golf ball 20 rather than drag or pull it when making a putting stroke. By pushing instead of dragging the golf ball 20, the player has more control over the direction of travel of the ball 20. In addition, with the stem mounted rearward of the striking body the player has better peripheral and overall vision during the putting stroke.

The center of mass cm of the putter head 10 is substantially located in the alignment platform 14 behind the striking body 12. The weight distribution and position of the stem 26 help to prevent twisting of the golf club during a putting stroke, i.e. the player is better able to make a straight, even putt.

Figure 3:
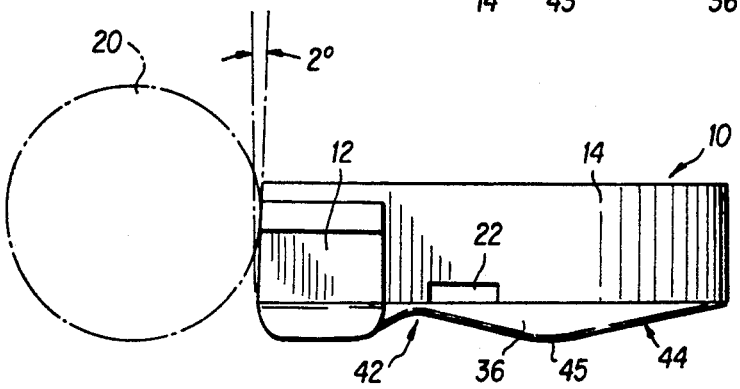
FIG. 3 illustrates a side view of the first embodiment of the present invention with the stem and shaft omitted.

Referring to FIG. 3, the bottom 36 of the putter head 10 has a concave portion 42. The concave portion 42 creates a cushion of air behind the striking body 12 to help the putter head 10 glide over the grass with less friction during the execution of a putting stroke. Also, the rear end 44 of the bottom 36 of the putter head 10 curves gently upward so that the putter head 10 does not catch the grass on the follow through of a stroke.

As illustrated in FIGS. 2 and 3, the golf putter preferably has a 2° loft. In addition, the shaft 30 is at a 12° incline to the vertical when the putter head is resting on the ground to allow the player a more natural grip of the putter.

Figure 4:
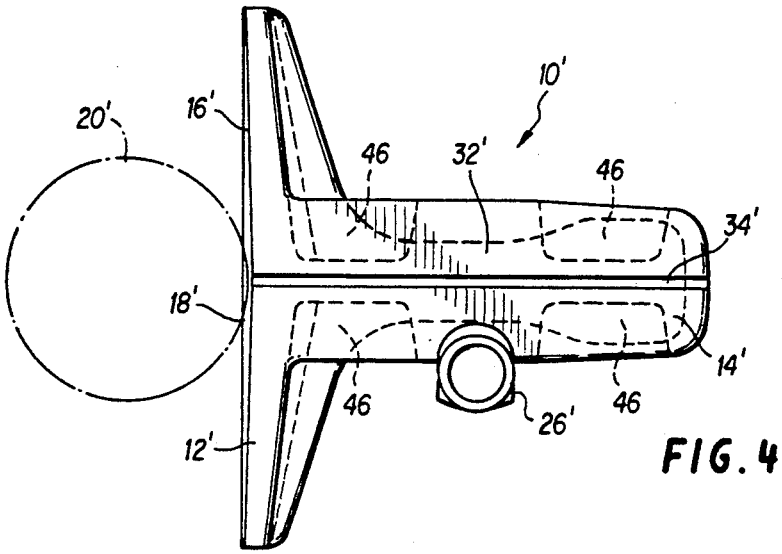
FIG. 4 illustrates a plan view of the putter head and stem of a second embodiment of the present invention.
Figure 5:
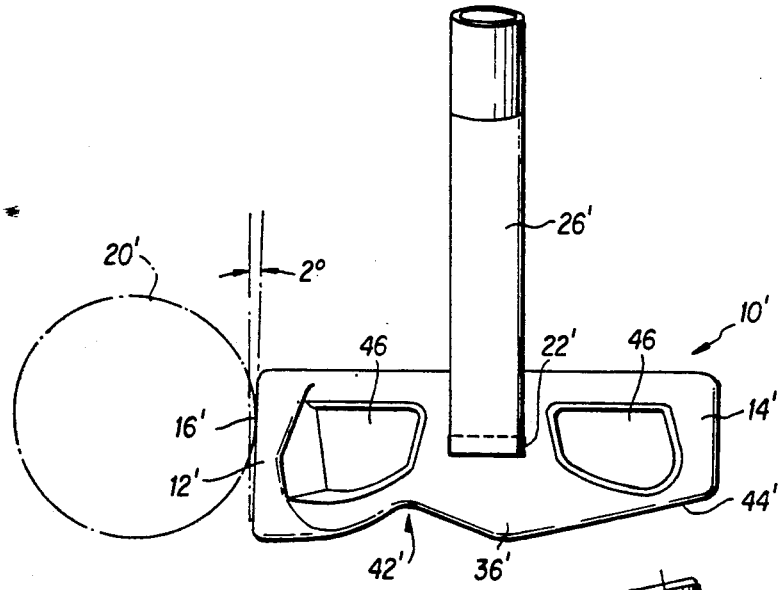
FIG. 5 illustrates a plan view of the putter head and stem of FIG. 4.
Figure 6:
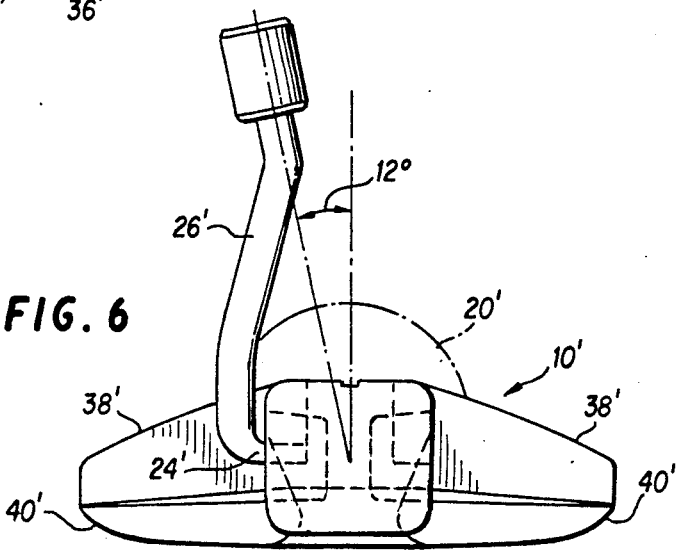
FIG. 6 illustrates a rear view of the putter head and stem of FIG. 4.

Referring to FIGS. 4–6, a second preferred embodiment of the invention is illustrated. Elements designated with a numeral having a "'" correspond to like elements having the same numeral in the embodiment of FIGS. 1–3. Rather than have the putter head 10 made from a combination of aluminum and brass, putter head 10' is made from all brass. To prevent the putter head 10', however, from being too heavy, cutouts 26 are provided so that the weight is decreased.

The putter head 10' has many of the same enhancement features as the putter head 10 including a "T" shaped configuration formed from a striking body 12' and an alignment platform 14', as well as a sighting surface 32' and stripe or groove 34'. As shown in FIG. 6, the lateral sides 38' of the striking body 12' slope downwardly away from the sighting surface 32' in order to promote the visual dominance of the sighting surface 32'. In addition, as illustrated in FIG. 5, the putter head 10' has a cushion-effect, concave portion 42' on the bottom surface 36' and an upwardly sloping rear portion 44'.

Besides assisting a player in executing a more accurate putt, the present golf putter also helps to accelerate the overall putting process. Two major concerns of a player preparing a putting stroke are the alignment of the putter head 10 and the actual distance the golf ball must travel. The distance the golf ball must travel is directly related to how much force the player must apply during the stroke.

With the conventional golf putter, the player ordinarily must concentrate on both the alignment and distance simultaneously. This may cause the player to take a relatively long time to prepare his or her putt. With the present invention, however, the player can quickly align the putter head 10 from behind and then move to a stroking stance. Once in the stroking stance, the player no longer needs to focus any of his or her attention on the alignment of the putter head 10 as the putter head 10 is already firmly in position. Instead, the player can devote all of his or her attention on the anticipated distance of travel for the golf ball. Psychologically, the player is benefited because he or she is not burdened by the need to concentrate on two major items at once. In the game of golf, any decrease in the mental strain placed on a player can appreciably reduce the amount of time spent in preparation of a stroke and can improve the overall execution of the stroke.

All the previously described features of the present invention together provide an overall improved golf putter that enhances the player's putting game from the alignment stage through the execution of the putting stroke. Although the invention has been described in terms of what are at present believed to be its preferred embodiments, it will be apparent to those skilled in the art that various changes can be made without departing from the scope of the invention. It is therefore intended that the appended claims cover such changes.

What is claimed is:

1. A golf club comprising:

a shaft;

a club head, said club head having an upper and bottom surface, a forward and a rear end, and a heel and opposing toe side; wherein said club head comprises an elongated striking body extending longitudinally from the heel to the toe side of said club head and said striking body has a ball striking face on a forward end thereof, and an elongated alignment platform extending rearwardly from said striking body substantially perpendicularly to said ball striking face such that said striking body and said alignment platform substantially form a T-shape; and a stem interconnecting said shaft and said club head, wherein one end of said stem is directly attached to the heel side of the alignment platform, said stem extending generally upwardly from said one end;

wherein said striking body has a bottom surface, said bottom surface being substantially flat in a central area thereof; and wherein said alignment platform has a bottom surface and an upper surface, said bottom surface of said alignment platform having a first portion rearward of the striking body that is concaved, and a second portion rearward of said concaved portion; and wherein said second portion and said substantially flat central area of the bottom surface of said striking body lie in a plane which is substantially parallel to the upper surface of the alignment platform.

2. The golf club of claim 1, wherein said club head further comprises a sighting surface for assisting a player in aligning said club head, said sighting surface extending from the forward to the rear end of the club head along the upper surface of said alignment platform and said striking body and having a width approximately coextensive with the width of the alignment platform.

3. The golf club of claim 2, wherein said striking body, alignment platform, and sighting surface are integral.

4. The golf club of claim 2, wherein said sighting surface is at a higher elevation than the upper surface of said striking body.

5. The golf club of claim 2, wherein said sighting surface is substantially flat.

6. The golf club of claim 2, wherein a major portion of said sighting surface is a relatively light color selected to be sufficiently visible to draw the attention of a player thereto.

7. The golf club claim 6, wherein said sighting surface includes a stripe, having a relatively dark color, extending centrally from the forward to the rear end thereof.

8. The golf club of claim 6, wherein a substantial portion of the club head has a relatively dark color with the exception of the sighting surface.

9. The golf club of claim 1, wherein said club head comprises aluminum with a layer of brass on the bottom surfaces of said alignment platform and said striking body thereof.

10. The golf club of claim 1, wherein said one end of said stem has a rectangular configuration and said club head has a rectangular slot in a lower portion of the heel side of said alignment platform for receiving said one end of said stem.

11. The golf club of claim 1, wherein said ball striking face has approximately a two degree loft.

12. The golf club of claim 1, wherein an upper surface of said striking body slopes downwardly towards the heel and toe sides.

13. The golf club of claim 1, wherein the club head has a center of mass located rearward of the striking body.

14. The golf club of claim 1, wherein the bottom surface of the striking body curves upwardly towards the heel and toe sides.

15. The golf club of claim 1, wherein the bottom surface of the alignment platform has a third portion, rearward of said second portion, that curves upwardly towards the rear.

16. The golf club of claim 1, wherein said club head comprises brass.

17. The golf club of claim 16, wherein said club head has at least one cavity for decreasing the weight of said club head.

18. A golf club comprising:

a shaft;

a club head, said club head having an upper and bottom surface, a forward and a rear end, and a heel and opposing toe side; wherein said club head comprises an elongated striking body extending longitudinally from the heel to the toe side of said club head and said striking body has a ball striking face on a forward end thereof, and an elongated alignment platform extending rearwardly from said striking body substantially perpendicularly to said ball striking face such that said striking body and said alignment platform substantially form a T-shape; and a stem interconnecting said shaft and said club head, wherein one end of said stem is directly attached to the heel side of the alignment platform, said stem extending generally upwardly from said one end;

wherein said alignment platform has a bottom surface and an upper surface, said bottom surface of said alignment platform being concaved in a region rearward of the striking body; and wherein said one end of said stem has a substantially rectangular configuration and said club head has a corresponding rectangular slot in a lower portion of the heel side of said alignment platform for receiving said one end of said stem, said one end of said stem having four distinct sides that form the rectangular configuration such that one side lies in a plane substantially parallel to said upper surface of the alignment platform.

19. The golf club of claim 1, wherein said concaved portion of said bottom surface of said alignment platform curves about a longitudinal axis that extends from said heel to said toe side of said club head.

* * * * *